United States Patent [19]

Trachte

[11] Patent Number: 4,598,867

[45] Date of Patent: Jul. 8, 1986

[54] FUEL INJECTION NOZZLE FOR INTERNAL COMBUSTION ENGINES

[75] Inventor: Dietrich Trachte, Leonberg, Fed. Rep. of Germany

[73] Assignee: Robert Bosch GmbH, Stuttgart, Fed. Rep. of Germany

[21] Appl. No.: 659,913

[22] Filed: Oct. 11, 1984

[30] Foreign Application Priority Data

Feb. 14, 1984 [DE] Fed. Rep. of Germany ..... 3405161

[51] Int. Cl.[4] ..... B05B 1/32; F02M 61/00

[52] U.S. Cl. ..... 239/453; 239/533.12

[58] Field of Search ..... 239/453, 533.2, 533.12

[56] References Cited

U.S. PATENT DOCUMENTS 4,417,693 11/1983 Füssner et al. ..... 239/453
4,516,729 5/1985 Füssner et al. ..... 239/453
4,531,676 7/1985 Seifert et al. ..... 239/453

FOREIGN PATENT DOCUMENTS 3149276 6/1983 Fed. Rep. of Germany ... 239/533.9
3220398 7/1983 Fed. Rep. of Germany ... 239/533.3

*Primary Examiner*—Andres Kashnikow
*Assistant Examiner*—Patrick N. Burkhart
*Attorney, Agent, or Firm*—Edwin E. Greigg

[57] ABSTRACT

A fuel injection nozzle for internal combustion engines, having a valve needle loaded with a closing spring and having a damping device which damps the end stroke ($h_2$), leading into the fully open position of the valve needle, in accordance with the number of strokes and/or stroke length of the valve needle or with the quantity of fuel put through per injection event. The valve needle is coupled with a second damping device, which in partial-load and full-load operation also, at least intermittently, damps the initial stroke ($h_1$), leading out of the closing position, of the valve needle. As a result it is attained that for a wide range of the performance graph, the ratio of the injection quantity to the duration of injection can be optimized in terms of the fuel consumption and emission of toxic substances, without having to accept increased combustion noise in the critical ranges.

7 Claims, 7 Drawing Figures

FUEL INJECTION NOZZLE FOR INTERNAL COMBUSTION ENGINES

BACKGROUND OF THE INVENTION

The invention is based on a fuel injection nozzle of the type generally defined hereinafter. In injection nozzles of this type, which are distinguished by a variable stroke stop, a favorable ratio of the injection quantity to the duration of injection can be attained both in the high rpm and/or load range and during engine idling. It has been found, however, that for the sake of minimizing idling noise, the throttled passage leading into the work chamber of the damping device should have the smallest possible cross section. However, that necessitates a relatively great restoring spring force, and furthermore a considerable initial stroke or pre-stroke can become established in the partial and full load ranges. That, in turn, causes a steep rise in the course of injection, resulting in marked combustion noise.

This disclosure is a further improvement on my earlier patent application Ser. No. 597,100 filed Apr. 5, 1984. This application is also assigned to the assignee of my earlier case.

OBJECT AND SUMMARY OF THE INVENTION

The apparatus according to the invention has the advantage over the prior art that over a wide range of the perforance graph of the engine, the ratio of the injection quantity to the duration of injection can be optimized in terms of fuel consumption and the emission of toxic substances, without having to accept increased combustion noise as a result.

Advantageous further embodiments of the subject of the application are attainable with the provision disclosed in the specification and claims hereinafter.

It is particularly advantageous if the action of the second damping device above a predetermined threshold value for the fuel pressure is independent of the opening speed and at least approximately adheres to its magnitude associated with the threshold value. As a result, without additional provisions being required, it is possible to generate a pre-stream of fuel in the ranges of the engine performance graph that are critical in terms of noise development.

It is also possible, in injection nozzles having valve needles that open in the flow direction of the fuel, to generate the desired course of injection in a controlled manners without additional, stroke-controlled throttle cross sections in the flow path of the fuel merely by appropriately embodying and adapting the damping means. As a result, gaps which would be in danger of becoming plugged by carbonization are avoided, and the fuel that is to be ejected is well prepared, even during starting and while idling.

The invention will be better understood and further objects and advantages thereof will become more apparent from the ensuring detailed description of two preferred embodiments taken in conjunction with the drawings.

DESCRIPTION OF THE PREFERRED EMBODIMENTS

Figure 1:
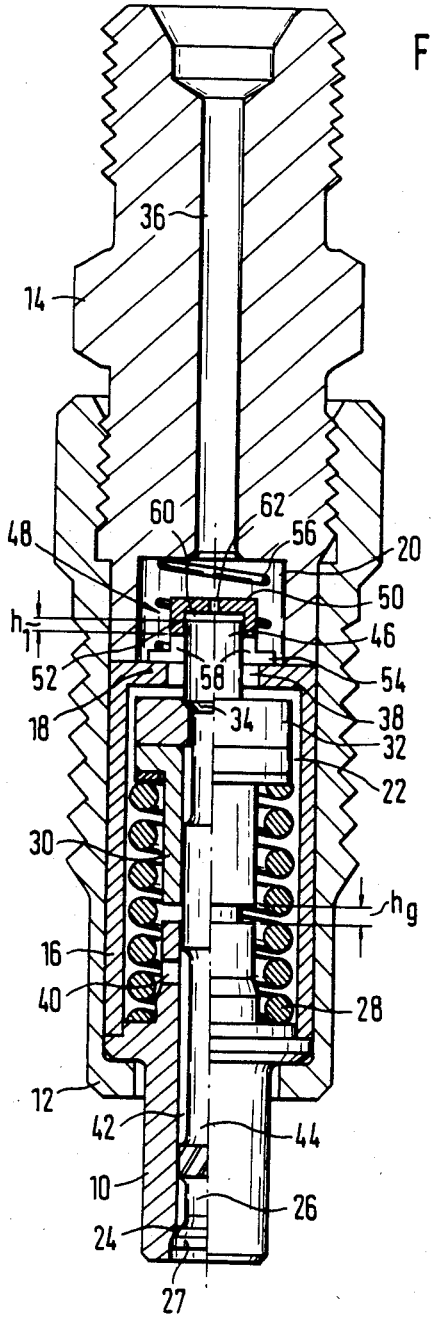
FIG. 1 is a longitudinal cross section taken through my improved fuel injection nozzle.

The generic injection nozzle shown in FIG. 1 has a nozzle body 10, which if firmly clamped by a sleeve nut 12 to a nozzle holder 14. Between the nozzle body 10 and the nozzle holder 14, there is a sheath 16, which has an inwardly oriented shoulder 18, which divides a chamber 20 from a chamber 22 of larger diameter in the interior of the injector nozzle. A valve seat 24 is formed and a valve needle 26 displaceably supported in the nozzle body 10, the sealing cone 27 of the valve needle 26 being pressed against the valve seat 24 by a closing spring 28. The closing spring 28 is supported on the nozzle body 10 and via a sheath 30, defining the stroke of the valve needle 26, engages a support disc 32, which in turn is supported on a shoulder 34 of the valve needle 26.

An inflow bore 36 which discharges into the chamber 20 is formed in the nozzle holder 14, and the chamber 20 communicates via an opening 38 surrounded by the shoulder 18 with the chamber 22. From this chamber, a bore 40 in the nozzle body 10 leads into an annular chamber 42, which is formed between the bore in the nozzle body 10 that gives the valve needle 26 and a section 44 of reduced diameter of the valve needle 26 and extends to a point just before the valve seat 24. In the closed position shown, there is a distance $h_g$ between the sheath 30 and the nozzle body 10, which corresponds to the total stroke of the valve needle 26. The valve needle 26 is displaced outward in the opening direction by the fuel pressure, counter to the closing spring 28, until the sheath part 30 strikes the nozzle body 10. When the valve closes, the closing spring 28 guides the valve needle 26 inward into the closing position shown.

The shoulder 34 of the valve needle 26 is adjoined by a piston-like extension 46, which passes through the opening 38 and protrudes into the chamber 20. The diameter of the piston-like extension 46 corresponds to the guide diameter of the valve needle 26. A cap 48 is seated upon the extension 46 and has a bottom 50, a jacket part 52 and a collar 54. The cap 48 is engaged by a restoring spring 56, which surrounds the jacket part 52 and presses the collar 54 against the shoulder 18 of the sheath 16.

Transverse slits 58 through which the fuel can always pass from the chamber 20 into the chamber 22, even when the valve needle is closed, are provided in the collar 54 and an adjoining region of the jacket part 52 of the cap 48. A damping chamber 60 is formed in the cap 48 between the front end of the extension 46 and the bottom 50, communicating in a throttled manner with the chamber 20 via a throttle bore 62 in the bottom 50. In the closing position shown, the piston-like extension 46 overlaps the transverse slits 58 in the cap 48 by the distance $h_1$ in the axial direction, which is greater than the total stroke $h_g$ of the valve needle 26. The distance $h_1$ could also, however, be a minimal amount smaller than the total stroke $h_g$, so that a slight undamped partial stroke still remains at the end of an opening stroke of the valve needle 26.

The throttle bore 62 could also be replaced either completely or in part by a corresponding radial play between the cap 48 and the extension 46. The piston-like extension 46 of the valve needle 26 and the cap 48 simultaneously embody the means for damping the valve needle movement and a time/travel [i.e., stroke length covered] member, which makes the onset of damping dependent on the rpm and on the magnitude of the valve needle stroke. The damping effect and the time/-travel function are fixed by means of appropriate matching of the restoring spring 56 to the throttle bore 62 and other parameters determining the flow of fuel into and out of the damping chamber 60.

The generic injection nozzle functions as follows:

By means of the increasing fuel pressure at the beginning of a first injection event, a pressure different immediately arises between the damping chamber 60 and the chamber 20, because the cap 48 is not capable of following the movement of the valve needle 26. The pressure increase in the damping chamber 60 takes place more slowly than in the chamber 20, so that the movement of the valve needle 26, upon this first stroke, is retarded or damped from the outset, until for instance the valve needle 26 has traveled the distance $h_1$ and the front end of the extension 26 reaches the vicinity of the transverse slits 58. From there on, a remaining stroke of the valve needle takes place without being damped, until the sheath 30 strikes the nozzle body 10. The position of the cap 48 shown will henceforth be called its first end position.

Upon the opening stroke of the valve needle 26 described, fuel is pressured through the throttle bore 26 into the damping chamber 60. Upon the ensuing closing stroke, the cap 48 is displaced via the fuel cushion in the damping chamber 60, being carried along upward into a position henceforth called its second end position. In this process, the restoring spring 56 offers only a relatively slight resistance to the substantially stronger closing spring 28, so that the closing stroke takes place substantially undamped.

From the onset of the closing stroke on, the restoring spring 56 presses the cap 48 back against the front end of the extension 46, whereupon the quantity of fuel that had previously flowed into the damping chamber 60 is now positively displaced back out of the damping chamber 60. This can in turn be effected only with a certain delay, because of the narrow throttle bore 62. The distance between the first and second end positions of the cap 48 corresponds approximately to the valve needle stroke, minus a slight return stroke which the cap 48, under the constant influence of the restoring spring 56, already begins to execute during the closing period of the valve needle 26.

The function of the time/travel member embodied by the cap 48 together with the damping chamber 60 and the restoring spring 56 will now be described, referring to the function diagrams in FIGS. 2–4. In these diagrams, the course of the valve needle stroke is plotted in solid lines h and the course of the deflection of the cap 48 is plotted in dashed lines a over the time t. In all three diagrams, the closing position of the valve needle 26 shown in FIG. 2 and the first first end position of the cap 48 are plotted on the time axis t.

At time $t_1$ (FIG. 2), the closing stroke of the valve needle 26 is supposed to begin, upon which the cap 48 is displaced out of its first end position $E_1$ to its second end position $E_2$. The cap 48 travels a distance $a_g$, which as already mentioned is somewhat shorter than the total stroke $h_g$ of the valve needle 26. The closing stroke is ended at time $t_2$. From then on, under the influence of the restoring spring 56, the cap 48 begins to move back at a predetermined speed; this is represented in the diagram as the angle $\alpha$.

At time $t_3$, a new opening stroke of the valve needle 26 begins. If at time $t_3$, as shown in FIG. 2, the cap 48 has not yet resumed its first end position, then it is returned to this first end position at approximately the same speed as the valve needle 26. It then reaches its first end position at time $t_4$. From then on, the cap 48 is restrained firmly by the shoulder 18 from any further movement in the opening direction of the valve needle 26, as a result of which the damping means described come into effect again. This is represented in the diagram by the break K in the curve of the stroke course at time $t_4$. From time $t_4$ on, the valve needle 26 is moved to its end stroke position at a damped, that is, reduced, speed, whereupon the course of events described is repeated.

Figure 2:
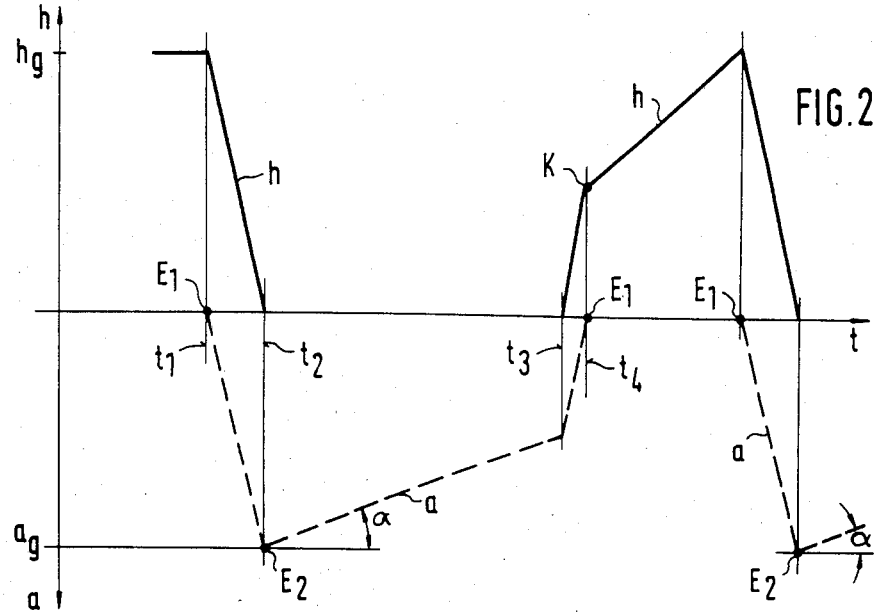
FIGS. 2–4 are function diagrams for the injection nozzle according to FIG. 1.
Figure 3:
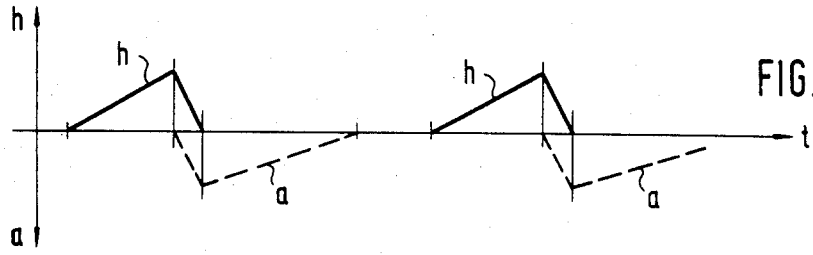
Figure 4:
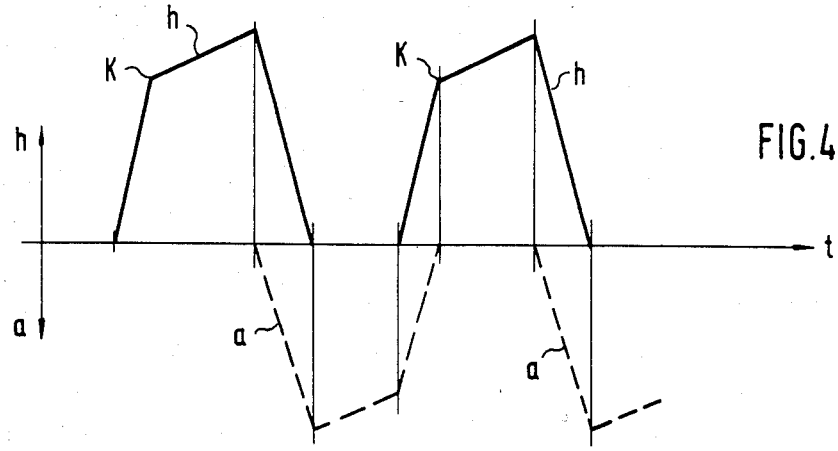

FIGS. 3 and 4 show that the damping device adapts automatically to the various operating states of the engine. In FIG. 3, the engine is operating at low rpm and low load, so that the cap 48 already reaches its first end position before the beginning of the next opening stroke. In this case, the damping is effective over the entire opening stroke of the valve needle 26. FIG. 4 illustrates an operating state in which the engine is running at high rpm and under a heavy load, at which a long valve needle stroke is established as well. In this case, the next opening stroke begins before the cap 48 has returned to its first end position. The break K in the stroke course h of the valve needle 26 is shifted still further toward the end of the stroke than in the operating state of FIG. 2, so that a shorter portion of the opening movement of the valve needle 26 is damped as well. FIG. 4 shows clearly that the break K is shifted more toward the opening stroke end $h_g$ of the valve needle, the more rapid the succession of injection events and the longer the duration of injection.

Figure 5:
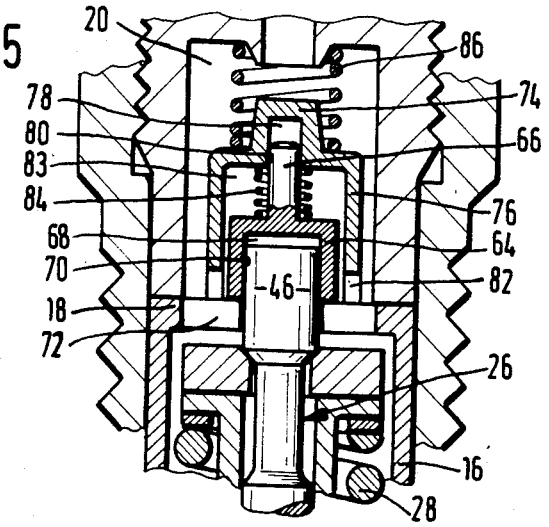
FIG. 5 is a fragmentary longitudinal section, on an enlarged scale as compared with FIG. 1, taken through the first exemplary embodiment of the invention.

In the injection nozzle according to the first exemplary embodiment of the invention shown in FIG. 5, a first cap 64 is seated upon the piston-like extension 46 of the valve needle 26 and is joined integrally to an extension 66, which forms a second piston. Between the cap 64 and the front end of the extension 46, a first work chamber 68 for the fuel is formed, which communicates via the radial play 70 between the cap 64 and the extension 46 with the chamber 20 which is located in the flow path of the fuel. The shoulder 18 of the sheath 16 is associated with the cap 64 and serves as a stop integral with the housing. In this exemplary embodiment, the sheath 16 is interrupted by a plurality of uniformly distributed radial slits 72, through which the fuel can flow into the chamber 22 and into the radial play 70.

Seated upon the piston-like extension 66 of the first cap 64 is a second cap 74, which with an annular collar 76 fits with play over the first cap 64. A second work chamber 78 for the fuel is formed between the extension 66 and the second cap 74, communicating via the radial play 80 between the extension 66 and the cap 74 and via slits 82 in the collar 76 with the chamber 20. The two chambers 64 and 74 define between themselves a chamber 83, which communicates in an unthrottled manner with the chamber 20. In this chamber 83, the fuel exerts a force upon the cap 64 in the opening direction, the magnitude of this force being determined by the line pressure of the fuel prevailing in the chamber 20 and the size of the annular surface on the bottom of the cap 64, the latter being the result of the difference between the cross-sectional areas of the extension 46 and the extension 66.

The cap 64 is engaged by a restoring spring 84, which is supported on the inside of the cap 74. The cap 74 is engaged by a restoring spring 86, which is supported on the bottom, integral with the housing, of the chamber 20. In the outset position shown, the restoring springs 84 and 86, which are quite weak in comparison with the closing spring 28, have placed the caps 64 and 74 in contact with the shoulder 18 integral with the housing.

The function of the injection nozzle according to FIG. 5 will now be described, referring to the diagram of FIG. 6:

As in the generic injection nozzle of FIG. 1, an opening stroke of the valve needle 26 is supposed to begin at time $t_3$ (see FIG. 2). At this instant, the caps 64 and 74 are not yet supposed to have returned to their initial position shown in FIG. 5. It is further assumed that the radial plays 70, 80 and the restoring springs 84 and 86 are matched to one another in such a way that the remaining distance still to be traveled by the cap 64 until it attains the shoulder 18 is longer than the remaining distance to be traveled by the cap 74. After the line or inflow pressure of the fuel has, at time $t_3$, overcome the closing pressure of the closing spring 28, the valve needle 26 moves downward in an undamped manner, until the second cap 74, at time $t_3'$, strikes the shoulder 18. This first undamped pre-stroke of the valve needle 26 corresponds to line b in FIG. 6.

From time $t_3'$ on, the further opening movement of the valve needle 26 is effected without damping, because the fuel can flow only in a throttled manner via the radial plays 70, 80 behind the front ends of the piston-like extensions 46 and 66 and exert an opening force upon the valve needle. This force exceeds the force of the closing spring 28 by only a slight amount, or else equals it, so that the retarded valve needle 26 moves onward only at low speed. This injection phase corresponds to line c in FIG. 6, which is almost flat and curves slightly upward.

In the movement phase c, the fuel exerts three partial forces upon the cap 64, which are approximately equal to one another. The first partial force acts in the work chamber 78 upon the end face of the extension 66, and the second partial force is exerted in the chamber 83 upon the described annular surface on the bottom of the cap 64. The third partial force acts in the work chamber 68 upon the inner bottom face, defining the work chamber 68, of the cap 64. The third partial force acting in the work chamber 68 increases only slightly, corresponding to the spring constant of the closing spring 28, which in injection phase c compresses only slightly, while the partial force exerted in the chamber 83 increases more rapidly, with the line pressure of the fuel. The result is that the first partial force, and with it the fuel pressure, in the enlarging work chamber 78 drops.

At time $t_3''$, the pressure in the work chamber 78 has dropped to the vapor pressure of the fuel. From this instant on, the fuel pressure in the work chamber 78 cannot drop any further, and can no longer compensate for the further rise in the fuel pressure in the chamber 83. The partial force exerted in the chamber 83 upon the cap 64 now rapidly exceeds the force of the closing spring 28, causing the valve needle 26 to experience marked acceleration. The valve needle 26 and the cap 64 are now moved quickly in the opening direction as shown by line d in FIG. 6, until at time $t_4$ the cap 64 strikes the shoulder 18 and the valve needle 26 has executed the stroke $h_1$. From this instant on, the valve needle 26 is moved, retarded solely by the first damping device embodied by the elements 46, 64, 70, beyond an end stroke $h_2$ into the end position, which it attains at time $t_5$ and in which it has traversed the end stroke $h_e$.

Figure 6:
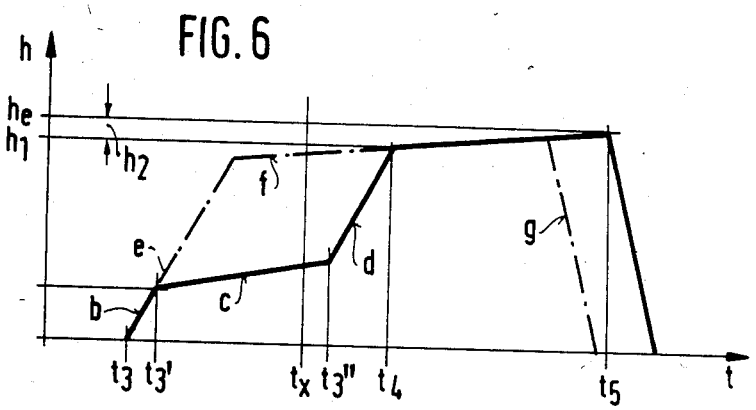
FIG. 6 is a function diagram for the injection nozzle according to FIG. 5.

In the diagram of FIG. 6, a dot-dash line e–f–g indicates how an injection nozzle of the type shown in FIG. 1 would function, given the same fuel throughput. It is assumed that at time $t_x$ the partial fuel quantity already injected has been thoroughly ignited. Then it is clear from the diagram that in the apparatus according to the invention, a smaller fuel quantity takes part in the thorough-ignition process, making it possible to abate noise and improve the quality of combustion. After the ignition, the fuel throughput is increased rapidly, so that as a result an equal quantity of fuel is put through per injection event as in the injection nozzle of FIG. 1.

As a result of the undamped raising of the valve needle 26 from the valve seal 24 (line b), it is attained that the range of very short needle strokes, in which laminar flow in the valve seat can occur (and thus only a very small fuel quantity, poorly prepared, can emerge), is traversed very quickly. In particular cases, this can also be dispensed with, so that line c begins at time $t_3$. Given an appropriate dimensioning of the damping means, an overlap at the valve seat 24 can be dispensed with in many cases. As a result, good fuel preparation is attained even with short valve needle strokes, that is, during starting and while idling.

Figure 7:
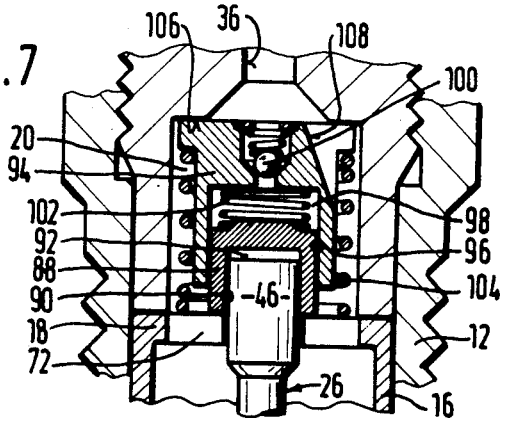
FIG. 7 is a fragmentary longitudinal section taken through the second exemplary embodiment.

In the injection nozzle of FIG. 7, a cap 88 is seated with radial play 90 upon the extension 46 of the valve needle 26. This cap 88 encompasses a first work chamber 92 and itself embodies a piston, upon which a second cap 94 is seated with radial play 96. The cap 94 encompasses a second work chamber 98, which communicates with the chamber 20 or the inflow bore 36 via a check valve 100, which permits a largely undamped expulsion of the fuel from the work chamber 98. The cap 88 is pressed against the shoulder 18 by a restoring spring 102 supported on the cap 94. The cap 94 is under the influence of a strong support spring 104, which presses the cap 94 against a stop 106 integral with the housing. For the passage of the fuel out of the inflow bore 36 into the chamber 20, the cap 94 is provided with one or more radial slits 108.

The injection nozzle of FIG. 7 functions as follows:

Upon the opening stroke of the valve needle 26, the fuel can reach the work chamber 92 and 98, via the radial gaps 90 and 96, and act upon the valve needle 26 only in a throttled manner, so that here again the opening stroke initially takes place in a damped manner. Analogously to the function of the injection nozzle of FIG. 5, at time $t_3'$ the pressure in the work chamber 98 has dropped to a critical value, at which in this case the biasing of the support spring 104 is overcome and the second cap 94, along with the valve needle 26 which from this time moves quickly onward, is guided downward. The arrangement is such that the second cap 94 still is spaced apart by a certain distance form the shoulder 18 when the first cap 88, at time $t_4$, comes to rest on the shoulder 18 and initiates the damped end stroke $h_2$ of the valve needle 26. Upon the closing stroke of the valve needle 26, the fuel is positively displaced out of the work chamber via the check valve 100 quickly and without notable resistance.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for internal combustion engines, having a housing, a valve needle (26), which is loaded by a valve needle closing spring (28) and urged in an opening direction during an opening stroke by fuel pressure, wherein an opening movement is effected in a direction of the flow path of a fuel flow, and further having a damping device (46, 64, 70 or 46, 88, 90), which in partial-load and full-load operation damps an end stroke ($h_2''$), leading to a fully open position of said valve needle (26) in accordance with a number of strokes and/or stroke length or a fuel quantity throughput per injection event and said damping device includes a first cap (64 or 88) seated upon a front end (46) of the valve needle (26) that encounters an oncoming fuel flow, said first cap is pressed by a restoring spring (84 or 102) against said front end of said valve needle (26) and with said front end encloses a fuel-filled work chamber (68 or 92), in which said work chamber communicates with a flow path (20) of the fuel only via a throttled passage (70 or 90) between said first cap and said front end and said first cap comes to rest at a beginning of the damped end stroke ($h_2$) on a stop (18) integral with the housing, subsequent to which the fuel can pass only via said throttle passage (70 or 90) alongside the end of the valve needle (26) during displacement of said valve needle, thereby enlarging the work chamber (68 or 92), wherein a damping effect is variable by shifting a timing of an onset of damping with respect to an injection onset, said valve needle (26) is coupled with a second damping device (66, 74, 80 or 88, 94, 96), which in partial-load and full-load operation also at least intermittently damps an initial stroke ($h_1$), leading out of a closing position, of the valve needle (26) and a fuel-filled second work chamber (78 or 98) communicating with the flow path (20) via a second throttled passage (80 or 96), in which said second work chamber is formed between a second piston (66 or 88) and a second cap (74 or 94) mounted upon said second piston wherein said second piston (66 or 88) is associated with said first cap (64 or 88), and said second cap (74 or 94) is associated with a restoring spring (86 or 104), and said stop (18 or 106) integral with the housing.

2. An injection nozzle as defined by claim 1, in which said second piston has a smaller diameter than said first piston, and further that said second cap is acted upon by said other restoring spring in the same direction as that in which the first cap is acted upon by the first restoring spring and said second cap is dimensioned such that upon the opening stroke of said valve needle said second cap comes to rest earlier than said first cap.

3. An injection nozzle as defined by claim 1, further wherein an effect of the second damping device above a predetermined value of the fuel pressure, is independent of an opening speed and at least approximately adheres to its magnitude associated with the predetermined value.

4. An injection nozzle as defined by claim 2, further wherein parameters influencing an action of said second damping device are adapted to one another and to the valve needle closing spring in such a manner that the fuel pressure in the second work chamber has dropped to a vapor pressure of the fuel when the fuel pressure attains the predetermined value.

5. An injection nozzle as defined by claim 3, further wherein parameters influencing an action of said second damping device are adapted to one another and to the valve needle closing spring in such a manner that the fuel pressure in the second work chamber has dropped to a vapor pressure of the fuel when the fuel chamber attains the predetermined value.

6. An injection nozzle as defined by claim 1, further wherein said second cap is supported on a stop integral with the housing counter to the flow direction of the fuel, and further that said second work chamber additionally communicates with the flow path of the fuel via an unthrottled passage, said unthrottled passage arranged to contain a check valve which opens counter to the fuel flow path, and further that parameters determining an action of the second damping device are adapted to one another and to the valve needle closing spring in such a manner that a biasing force of a support spring adapted to urge the second cap against said stop is overcome when an opening speed of the valve needle attains the opening value.

7. An injection nozzle as defined by claim 3, further wherein said second cap is supported on a stop integral with the housing counter to the flow direction of the fuel, and further that said second work chamber additionally communicates with the flow path of the fuel via an unthrottled passage, said unthrottled passage arranged to contain a check valve which opens counter to the fuel flow path, and further that parameters determining an action of the second damping device are adapted to one another and to the valve needle closing spring in such a manner that a biasing force of a support spring adapted to urge the second cap against said stop is overcome when an opening speed of the valve needle attains the opening value.

* * * * *